United States Patent [19]

Hadekel et al.

[11] 4,261,308

[45] Apr. 14, 1981

[54] FUEL CONTROL SYSTEMS

[75] Inventors: Ruben Hadekel, London; Edgar P. Peregrine; Alexander W. Swales, both of Royston, all of England

[73] Assignee: Trico Products Corporation, Buffalo, N.Y.

[21] Appl. No.: 36,918

[22] Filed: May 7, 1979

[30] Foreign Application Priority Data

May 10, 1978 [GB] United Kingdom ..... 18714/78

[51] Int. Cl.[3] ..... F02M 59/42

[52] U.S. Cl. ..... 123/179 L; 123/179 G; 123/495

[58] Field of Search ..... 123/179 G, 179 L, 139 ST, 123/139 AZ, 198 DB

[56] References Cited

U.S. PATENT DOCUMENTS

| | | | |
|---|---|---|---|
| 3,727,598 | 4/1973 | Knapp | 123/179 G |
| 3,797,465 | 3/1974 | Hobo et al. | 123/179 G |
| 4,136,657 | 1/1979 | Tanaka et al. | 123/139 ST |
| 4,147,148 | 4/1979 | Ito et al. | 123/179 L |
| 4,160,434 | 7/1979 | Daborowski et al. | 123/179 G |
| 4,177,788 | 12/1979 | Morita et al. | 123/179 L |

*Primary Examiner*—Charles J. Myhre
*Assistant Examiner*—Andrew M. Dolinar
*Attorney, Agent, or Firm*—E. Herbert Liss

[57] ABSTRACT

A fuel control system for a diesel engine comprises a fuel pump with a fuel control member and an excess fuel member. A reversible electric motor drives a rotary member which cooperates with these two members. The driver can control a switch to "stop" and "run". A heat-sensitive switch on the engine responds to "cold" or "hot". An electric circuit causes the engine when cold to start with automatic transient actuation of the excess fuel member.

5 Claims, 11 Drawing Figures

+
−
+
+
30
51
33
S
S31
S32
R36
R37
35
40
35a
38
39
42
44
46
R43
44a
41
45
R
45a
34

FUEL CONTROL SYSTEMS

There is an increasing tendency for diesel engines to be installed as power units in the smaller sizes of motor vehicle, in particular in light vans. Such vehicles may often be driven by people having no previous experience of diesel engines; this is particularly the case with hired vehicles. In this situation, it is desirable that the driver should be presented with controls which do not obviously differ from the familiar controls of a petrol-engine vehicle.

The present invention is concerned with fuel control systems for diesel engines which have been devised with this need in mind, although of course fuel control systems according to the invention can be applied to diesel engines in any circumstances.

A fuel control system according to the present invention comprises:

(a) a fuel control member movable between "run" and "stop" positions;

(b) an excess fuel member movable between "normal" and "excess" positions;

(c) a rotary member movable between "stop", "run", and "cold start" positions, and cooperating with the fuel control member and with the excess fuel member to cause them to assume the following positions:

| | rotary member | fuel control member | excess fuel member |
|---|---|---|---|
| (A) | stop | stop | |
| (B) | run | run | normal |
| (C) | cold start | run | excess; |

(d) a reversible motor drivingly coupled to the rotary member;

(e) driver control means actuable to "stop" and "run" conditions;

(f) engine temperature responsive means capable of assuming "cold" and "hot" conditions;

(g) detector means responsive to the positions of the rotary member; and (h) a circuit interconnecting the driver control means, the engine temperature responsive means, the detector means, and the motor, whereby:

(D) driver control means "run" condition and engine temperature responsive means "hot" condition cause the rotary member to assume "run" position, (E) driver control means "run" condition and engine temperature responsive means "cold" condition cause the rotary member to assume "cold start" position, and thereupon automatically to assume "run" position, and (F) driver control means "stop" condition causes the rotary member to assume "stop" position.

Preferably the reversible motor is electric, the circuit is therefore an electric circuit, the driver control means is a switch adjacent to the steering wheel, and the engine temperature responsive means is a temperature-sensitive switch installed at an appropriate place on the engine, for example in the cooling jacket. The driver control switch can in fact be actuated by turning a lock cylinder by means of a key, in the customary manner, this cylinder also actuating a steering column lock and a control switch for a starter motor.

The fuel control member may constitute a modification of a "stop" lever on a standard fuel pump. The excess fuel member can be an existing component of a standard fuel pump. The rotary member and the motor, together with suitable reduction gearing, can be contained in an auxiliary housing which is bolted onto a standard fuel pump housing.

The circuit components can be in a unit mounted in a convenient position in the vehicle, and connected by wiring to the auxiliary housing, to the driver control switch, and to the temperature-sensitive switch on the engine.

In this preferred electrical system, the detector means can consist of a plurality of limit switches, actuated by cams carried by the rotary member. These limit swithces are mounted within the auxiliary housing.

The accompanying drawings show one embodiment of the invention, and an alternative circuit arrangement. In these drawings.

Figure 1:
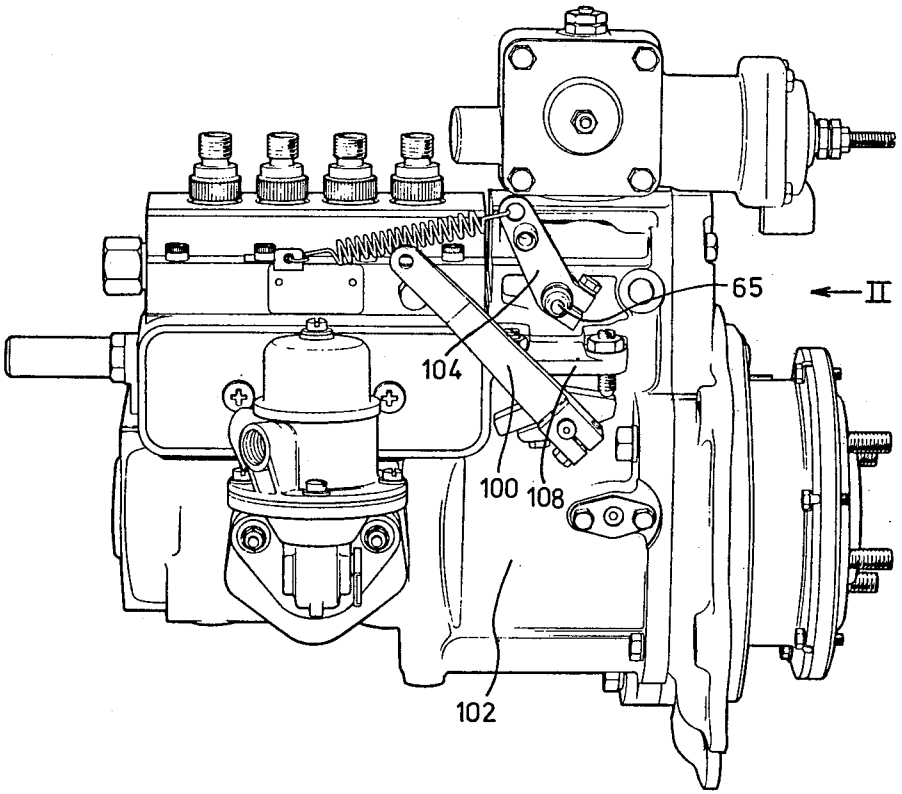
FIG. 1 is a side perspective view of a known fuel injection pump.

The pump shown in FIG. 1 is a standard fuel injection pump for a four cylinder diesel engine. It is in fact a pump made by CAV Limited of London, England under the name "Minimec". For the purposes of the present invention, the only relevant parts of the pump are the external controls. These are:

a lever 100, which is connected to a "throttle" pedal, and which serves to control the speed of engine 80, in conjunction with a governor within the portion 102 of the pump housing, a lever 104 which can be swung through an arc clockwise to stop the engine 80, a cap 65 which can be depressed to increase the fuel supply for starting the engine 80 when cold.

On the side of the housing of the pump is a flange 108, carrying stop screws for the lever 100.

In carrying out the present invention, the pump shown in FIG. 1 is modified by slight alterations, plus the addition of auxiliary equipment, described below.

Figure 2:
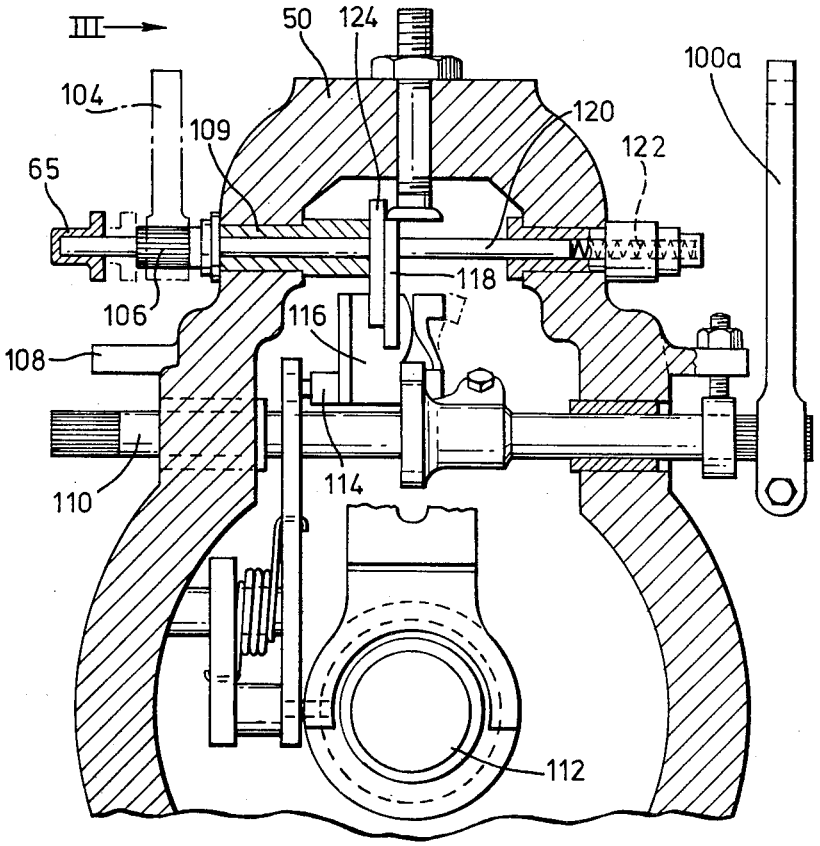
FIG. 2 is a fragmentary end view looking in the direction of the arrow II in FIG. 1, with components removed from the end.

The slight modifications are shown in FIG. 2:

The lever 104 is removed, leaving a splined end 106 of a hollow shaft 109.

The lever 100 is removed from the left-hand end of a shaft 110, and placed instead at 100*a* on the right-hand end of the shaft 110.

The stop screws are removed from the flange 108, which is then free to receive the auxiliary equipment.

The function of the normal controls will be explained briefly with reference to FIG. 2:

Rotation of the shaft 110 by the lever 100, in conjunction with a centrifugal governor rotated by a pump shaft 112 driven by the engine 80, serves to vary the position of a control rod 114. This control rod 114 moves longitudinally, i.e. in and out of the plane of FIG. 2. Movement out of the plane increases the delivery of fuel to each engine cylinder at each cycle, while movement into the plane reduces the delivery of fuel.

To avoid emission of smoke under normal running, the maximum fuel is normally limited by engagement of a bracket 116 on the control rod 114 with a stop plate 118 carried by a rod 120. When the engine is to be started from cold, the rod 120 is pushed to the right, by pressure on the cap 65 at its left-hand end, and this displaces the stop plate 118 out of register with the bracket 116. Consequently the control rod 114 is permitted to move further out of the plane of FIG. 2, thus causing fuel enrichment when the engine is started.

The rod 120 is returned by a spring 122 when the engine is running.

The hollow shaft 109 carries a plate 124. When the lever 104 is in anticlockwise extreme position (as shown in FIG. 1) the plate 124 does not affect the movements of the bracket 116. If, however, the lever 104 is swung clockwise through about 80°, the hollow shaft 109 turns the plate 124 so that a lug on the plate 124 pushes the bracket 116 into the plane of FIG. 2, to such an extent that the control rod 114 reaches an extreme position in which fuel to the engine cylinders is entirely cut off, and the engine 80 stops.

Figure 4:
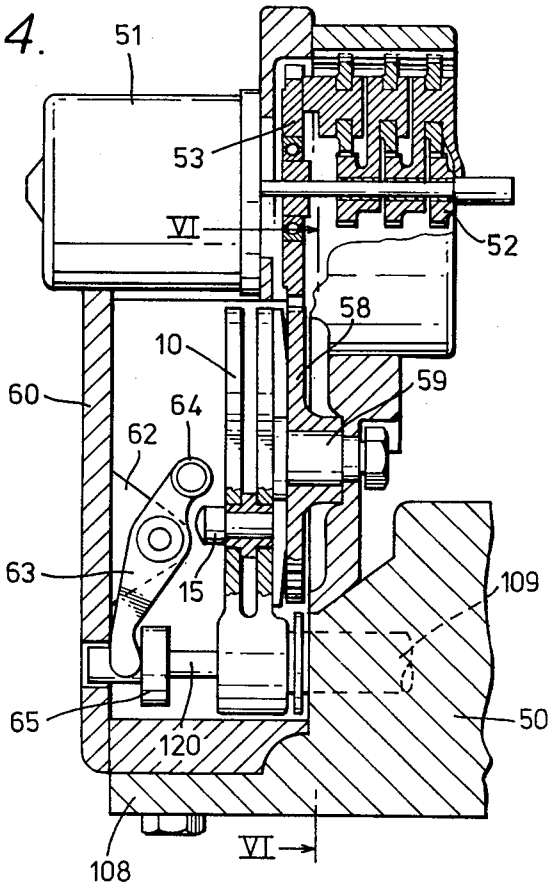
FIG. 4 is a view in the direction of the arrow IV in FIG. 3.
Figure 3:
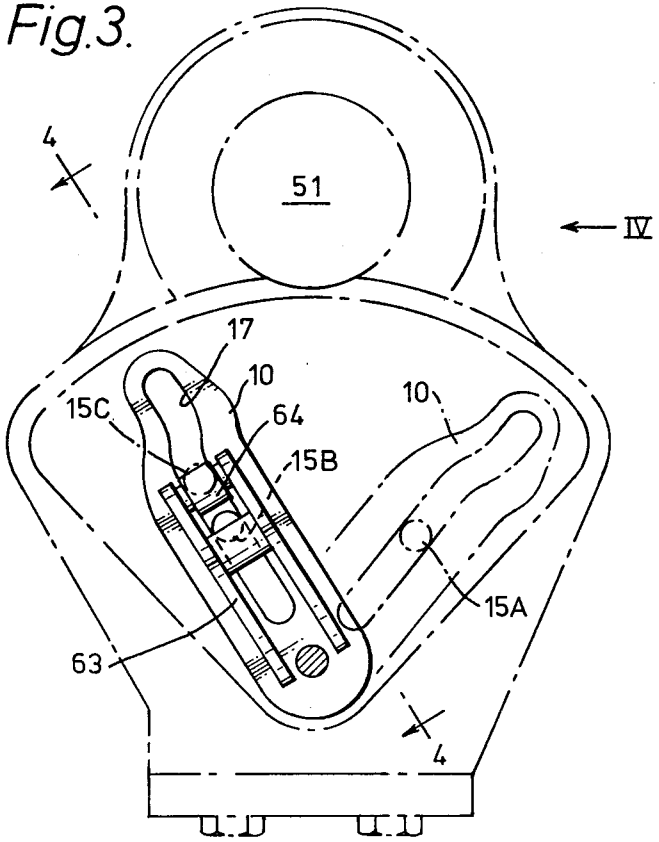
FIG. 3 is a view looking in the direction of the arrow III in FIG. 2, showing the outline of auxiliary equipment to be added to the pump of FIGS. 1 and 2.

The auxiliary equipment shown in FIGS. 3 and 4 lies against the upper part 50 of the housing of the fuel injection pump, and is bolted to the flange 108.

A reversible electric motor 51 (FIG. 4) drives the primary pinion 52 of a three-stage epicyclic reduction gear. The output gear wheel 53 drives a gear wheel 58 journalled on a short shaft 59.

A lever 10 is secured to the splined end 106 (FIG. 2) of the hollow shaft 109. This lever 10 can swing between two extreme positions shown in FIG. 3, namely "run" position in solid lines, and "stop" position in broken lines. In the lever there is a slot 17 cooperating with a pin 15 projecting from the gear wheel 58.

As described more fully below, when the engine 80 is to stop, the motor 51 rotates the pin to a "stop" position 15A. When the engine 80 is to run, the motor 51 rotates the pin to the "run" position 15B.

The pin 15 also serves indirectly to actuate the rod 120 when excess fuel is required for a cold start. For this purpose, brackets 62 on a cover 60 support a rocking lever 63 (in FIG. 4 these components are seen from a line 4–4 in FIG. 3). One end of the lever 63 carries a roller 64, while the other end cooperates with the cap 65 on the rod 120. For a cold start, the motor 51 temporarily moves the pin to the "cold start" position 15C, which has the effect of swinging the lever 63 anticlockwise as seen in FIG. 3, and thus shifting the rod 120 to the right (FIGS. 2 and 4).

Figure 5:
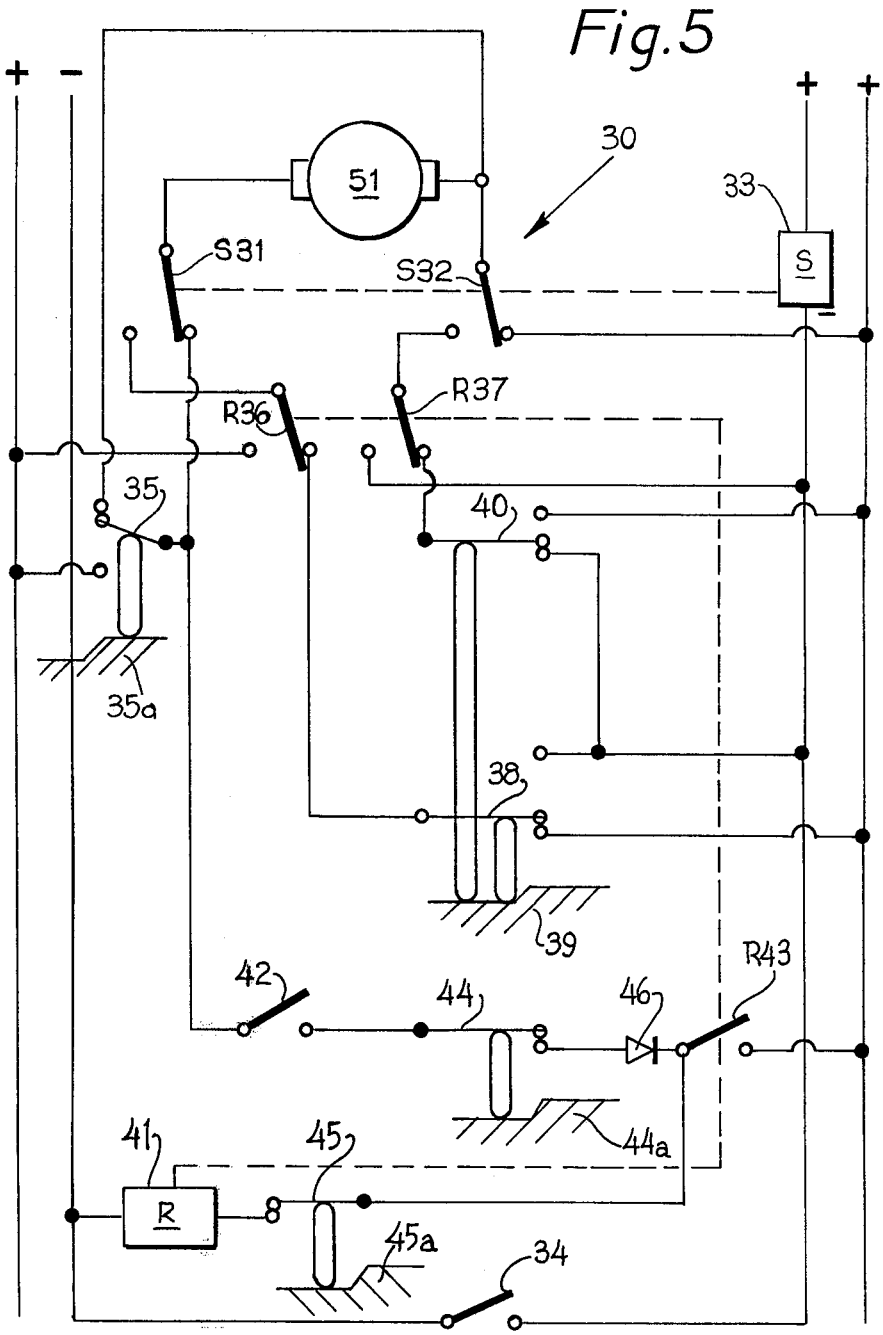
FIG. 5 is a circuit diagram associated with the auxiliary equipment of FIGS. 3 and 4.
Figure 6:
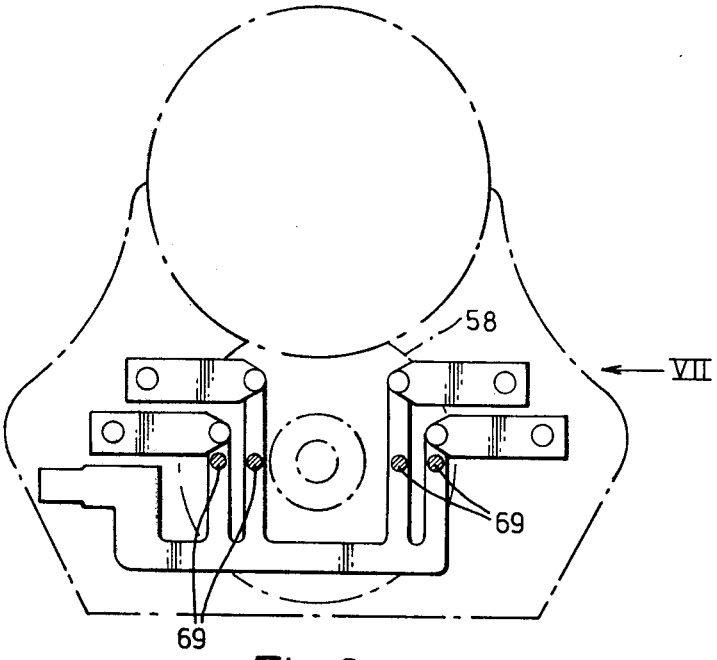
FIG. 6 is a view of electric contacts, on the line VI—VI in FIG. 4.
Figure 7:
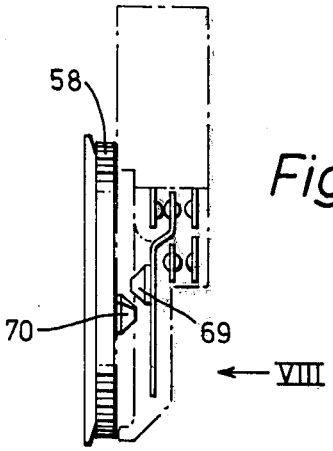
FIG. 7 is a view in the direction of the arrow VII in FIG. 6.
Figure 8:
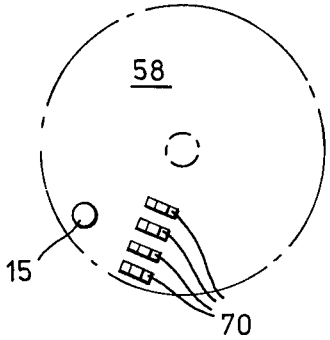
FIG. 8 is a fragmentary view in the direction of the arrow VIII in FIG. 7.

The operation of the motor 51 is controlled by the electric circuit 30 shown in FIG. 5. This circuit includes limit switches operated by cams carried by the gear wheel 58, as shown diagrammatically in FIGS. 6, 7 and 8. FIG. 6 shows the general layout of contact blades. FIG. 7 shows the position of cams 70 on the gear wheel 58, cooperating with followers 69 on movable contacts. FIG. 8 indicates that cams for different switches are relatively offset radially (but this Figure does not indicate the correct relative angular positions of the cams, which will be apparent from the functional description which follows).

The only externally-controlled elements of the circuit in FIG. 5 are:

A switch 34 which constitutes driver control means. This is open for "stop" condition, and closed for "run" condition. It is mounted near the steering wheel 82.

Switch 42 is in fact a temperature-sensitive switch which is installed at an appropriate place on the engine, for example in the cooling jacket. This switch 42 is open in "hot" condition, and closed in "cold" condition.

The switches are drawn for the engine 80 stopped. Then, in FIG. 3, the pin is in position 15A, with the lever 10 in the broken line position. To start the engine, the driver closes the switch 34 and thus energises a relay 33. This changes over contacts 31 and 32, and so causes the motor 51 to run in the direction which drives the gear wheel 58 clockwise, as seen in FIG. 3, thus causing the pin 15 to move clockwise.

Assuming that the engine 80 is hot, so that the switch 42 is open, the motor will stop when the pin reaches the "run" position 15B. This stopping is caused by reversal of a limit switch 38 by a cam 39. This reversal short circuits the motor, and stops it rapidly. If, however, the motor should overrun, then the cam 39 also changes over a limit switch 40, which causes the wheel 58 to run anticlockwise, to bring the pin back to the correct "run" position 15B.

If, however, the engine 80 is cold, the driver need take no special action; the temperature-sensitive switch 42 will be closed, with the following result.

As soon as the gear wheel 58 moves away from the "stop" position, a cam **35*a* changes over the contacts 35 and thereupon a relay 41 is energised. The effect is to changeover contacts 36 and 37, and also to close a contact 43, which is a self-holding contact. After the gear wheel 58 has turned part of the distance towards "run" position, a cam 44*a* opens a contact 44, so that the relay 41 remains energised only through the holding contact 43**.

The reversal of the contacts 36 and 37 means that the position switches 38 and 40 are bypassed, and the motor 51 continues to turn clockwise until the pin reaches the "cold start" position 15C. Thereupon a contact 45 is opened by a cam **45*a*. The pin only remains briefly in the "cold start" position 15C, because the opening of the contact 45 releases the relay 41, so that the contacts 36 and 37 return to the position shown. Thereupon, the wheel 58 runs anticlockwise until the pin reaches the "run" position 15B**.

A diode 46 is provided to prevent damage from short circuit if the unlikely condition should occur of the contact 35 being in the position shown when the contacts 42 and 43 are both closed.

When the driver opens the driver control switch 34, the relay 33 is released, and the contacts 31 and 32 return to the position shown in FIG. 5. In consequence the wheel runs anticlockwise to return the pin 15 to the "stop" position 15A. When this position is reached, the cam **35*a* returns the contact 35 to the position shown. This has the effect of short-circuiting the motor 51** so that it stops rapidly.

Figure 9:
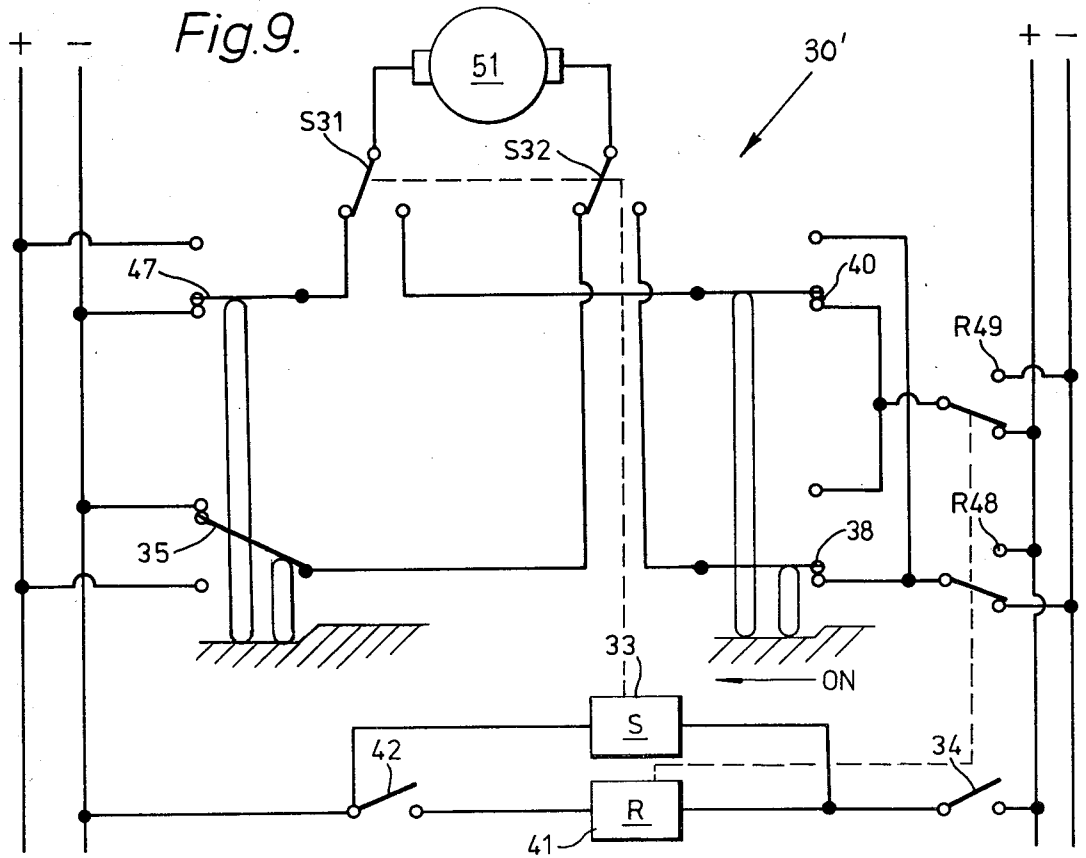
FIG. 9 is a diagram of a circuit which is an alternative to FIG. 5.
Figure 10:
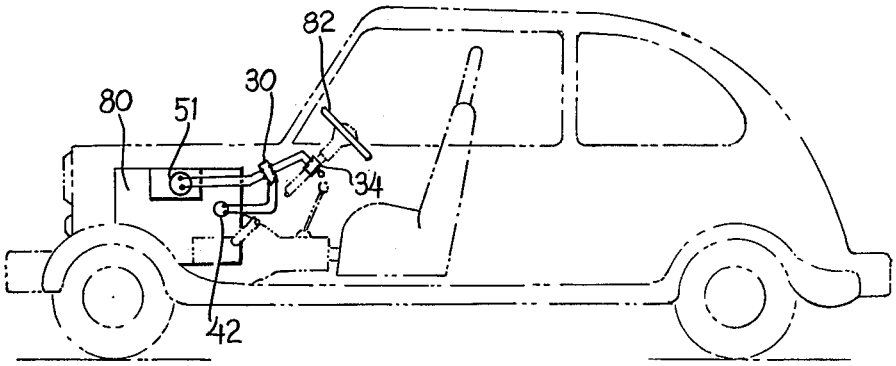
FIG. 10 is a diagramatic illustration of a motor road vehicle incorporation the invention.
Figure 11:
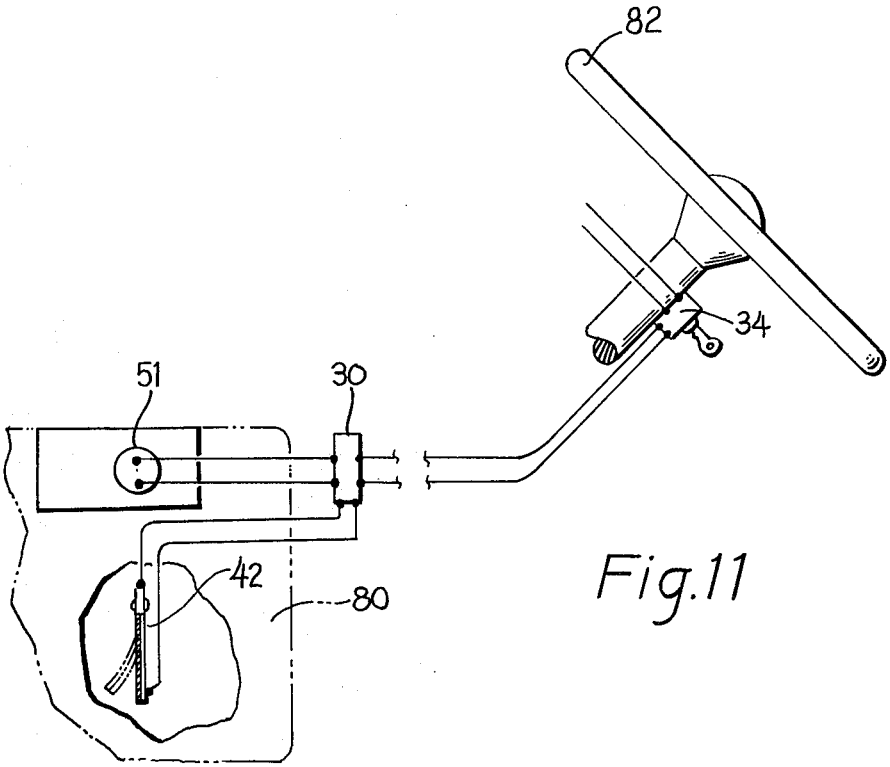
FIG. 11 is a detail of a portion of FIG. 10.

FIG. 9 shows an alternative circuit 30' which has the following effect. If the engine is stopped and is hot, then moving the driver control means to "run" causes the pin to move clockwise from "stop" position 15A to "run" position 15B (FIG. 3). If the engine is stopped and cold, then actuating the driver control means to "run" causes the pin to rotate anticlockwise from "stop" condition 15A, through "cold start" position 15C, continuing on to "run" position 15B. Subsequent actuation of the driver control means to "stop" causes the pin to move anticlockwise from 15B to 15A.

FIG. 9 shows the condition when the engine is stopped and hot. Closing the driver control switch 34 energises the relay 33 which changes over the contacts 31 and 32. Thereupon the wheel 58 rotates clockwise, until it is stopped by cam actuation of the contact 38, and also of the contact 40 if the motor has overshot.

If, however, the engine is cold, then the switch 42 is closed, and closing of the driver control switch 34 has the added effect of energising the relay 41. This changes over the contacts 48 and 49, and in consequence the wheel 58 starts to rotate anticlockwise. The motor runs continuously as the pin passes through the "cold start" position 15C, and the motor is stopped when the pin reaches 15B, by cams changing over the contacts 38, and 40 if necessary.

When the switch 34 is opened, the relay 33 is de-energised, and the contacts 31 and 32 return to the position shown. In consequence the wheel rotates anticlockwise, until the pin reaches the "stop" position 15A. At this position a cam changes over a contact 35 to cause short circuiting of the motor. If the motor overshoots, then a contact 47 is changed over by a cam and causes reversal of the motor.

Although the above example involves the use of a geared electric motor, the invention is not limited to this particular form of motor: any convenient motor the output of which can be reversed may be employed, for example a reversible hydraulic motor.

We claim:

1. A fuel control system comprising:

(a) a fuel control member movable between "run" and "stop" positions;

(b) an excess fuel member movable between "normal" and "excess" positions;

(c) a rotary member movable between "stop", "run", and "cold start" positions, and cooperating with the fuel control member and with the excess fuel member to cause them to assume the following positions:

| rotary member | fuel control member | excess fuel member |
|---|---|---|
| (A) stop | stop | |
| (B) run | run | normal |
| (C) cold start | run | excess; |

(d) a reversible motor drivingly coupled to the rotary member;

(e) driver control means actuable to "stop" and "run" conditions;

(f) engine temperature responsive means capable of assuming "cold" and "hot" conditions;

(g) detector means responsive to the positions of the rotary member; and (h) a circuit interconnecting the driver control means, the engine temperature responsive means, the detector means, and the motor, whereby:

(D) driver control means "run" condition and engine temperature responsive means "hot" condition cause the rotary member to assume "run" position, (E) driver control means "run" condition and engine temperature responsive means "cold" condition cause the rotary member to assume "cold start" position, and thereupon automatically to assume "run" position, and (F) driver control means "stop" condition causes the rotary member to assume "stop" position.

2. A system according to claim 1, wherein the reversible motor is electric, the circuit is electric, the driver control means is a switch, and the engine temperature responsive means is a temperature-sensitive switch.

3. A system according to claim 2, wherein the detector means consist of a plurality of limit switches, actuated by cams carried by the rotary member.

4. A fuel control system for a motor road vehicle having a diesel engine as power unit, a steering wheel and including associated with the engine a fuel control system according to claim 2, wherein the driver control means is a switch adjacent to the steering wheel, and the engine temperature responsive means is a temperature-sensitive switch installed at an appropriate place on the engine.

5. In a vehicle according to claim 4, including associated with the engine a fuel pump, the fuel control member being a modified "stop" lever on the fuel pump, the excess fuel member is a component of the fuel pump, and the rotary member and reversible motor are contained in an auxiliary housing which is secured to a housing of the fuel pump.

* * * * *